United States Patent [19]

Enberg et al.

[11] 4,447,016

[45] May 8, 1984

[54] REWIND APPARATUS FOR METAL STRIPS

[75] Inventors: Erik R. Enberg, Troy; J. Douglas Plank, Piqua, both of Ohio

[73] Assignee: Perfecto, Inc., Piqua, Ohio

[21] Appl. No.: 383,717

[22] Filed: Jun. 1, 1982

[51] Int. Cl.[3] ..... B65H 59/00; B21C 47/02

[52] U.S. Cl. ..... 242/56.9; 242/72 R; 242/75.52; 242/78.1; 192/71; 192/87.13; 192/88 B

[58] Field of Search ..... 242/56.4, 56.9, 72 R, 242/75.2, 75.52, 46.4, 56.5, 65, 78.1; 192/87.1, 87.11, 87.13, 88 B, 71; 226/195

[56] References Cited

U.S. PATENT DOCUMENTS

| | | | |
|---|---|---|---|
| 2,275,093 | 3/1942 | Spangler | 242/56.4 |
| 2,277,554 | 3/1942 | McCoy | 192/88 B X |
| 2,891,645 | 6/1959 | Hindmarch | 192/87.11 |
| 3,047,198 | 7/1962 | Long | 242/75.52 X |
| 3,075,720 | 1/1963 | Theobald | 242/72 |
| 3,386,679 | 6/1968 | Foulon et al. | 242/75.2 X |
| 3,406,924 | 10/1968 | Bruns et al. | 242/56.4 |
| 3,672,595 | 6/1972 | Jablin et al. | 242/75.2 |
| 3,817,468 | 6/1974 | Smolderen et al. | 242/56.9 |
| 3,921,926 | 11/1975 | Jöres et al. | 242/56.9 |
| 4,201,352 | 5/1980 | Madachy | 242/56.2 |

*Primary Examiner*—Stuart S. Levy
*Assistant Examiner*—Joseph J. Hail, III
*Attorney, Agent, or Firm*—Jacox & Meckstroth

[57] ABSTRACT

A web of metal is unwound from a coil and cut into longitudinal strips which are directed into corresponding loops and then through tension units to a set of strip rewind units each having a horizontal mandrel. Each rewind mandrel has a driven center shaft which supports independent mandrel sections for receiving and rewinding the separate strips into corresponding coils. Each mandrel section has a set of collapsible coil support shoes and is driven by a corresponding air actuated clutch. The air pressure to each clutch is precisely varied by a control system which senses changes in the corresponding loop in the steel strip so that each steel strip is rewound independently of the other steel strips. Thus all of the steel strips are rewound at substantially constant tension into corresponding rewind coils independent of variations in thickness of the strips and in elongation of the strips due to internal stresses. Each mandrel section is locked to the shaft in a predetermined orientation to facilitate removal of the rewound coils after the shoes are collapsed.

15 Claims, 10 Drawing Figures

REWIND APPARATUS FOR METAL STRIPS

BACKGROUND OF THE INVENTION

In the art of converting a coil of sheet steel or other sheet metal into separate strips which are rewound into corresponding separate coils, the wide metal strip or web is usually directed through a slitting unit or a punch press to form the separate strips which are rewound into corresponding coils. A number of various types of rewind apparatus or systems have been either used or proposed, for example, as disclosed in U.S. Pat. Nos. 3,406,924, 3,672,595, 3,817,468 and 4,201,352. As discussed in Pat. Nos. 3,406,924 and 4,201,352 a problem is encountered during rewinding of a plurality of strips which are slit or cut from a web of metal such as sheet steel. This problem results from the fact that the center portion of the web is usually thicker than the longitudinal edge portions of the web due to slight bowing of the mill rolls during the rolling operation. It also appears that during the rolling operation, some portions of the web develop internal stresses different from the stresses within other portions of the web causing some of the resulting strips to elongate slightly relative to other strips after the straightening and slitting operations.

The differences in the strips make it desirable to rewind the strips independently at slightly different speeds and for a uniform drag to be applied to the strips in order to obtain a generally uniform tension in the strips during the rewinding operation. If the strips are not rewound at slightly different speeds, it is necessary to provide for a pit within the floor to accommodate the length build up of depending loops formed by accumulations in the strips due to slightly differential thicknesses and stretch in the strips.

In the above-mentioned Pat. No. 3,406,924, the rewinding of the strips is performed on a slip core rewind mandrel wherein each strip is rewound on a corresponding cylindrical metal core and each core is friction driven on opposite ends by thin drive rings which separate the cores. In above-mentioned Pat. No. 4,201,352, the separate strips are rewound on separate corresponding drums or mandrel sections which expand and contract to regulate the frictional contact between the mandrel sections and the first turns or convolutions of the rewound strips.

SUMMARY OF THE INVENTION

The present invention is directed to improved apparatus for simultaneously rewinding a plurality of metal strips which are cut from a wide metal strip or web and which provides for rewinding all of the strips into corresponding coils with a substantially constant and uniform tension within the strips. The rewinding apparatus of the invention eliminates the need for constructing a pit to accommodate progressive accumulations of the strips in a form of loops and assures that all of the coils are wound with substantially the same tightness.

In general, the above-mentioned features and advantages are provided by a strip rewind system wherein each cut strip is directed downwardly to form a depending loop and is then directed through a corresponding tension unit which produces a preselected drag or tension within the strip independent of variations in thickness and in the speed of the strip. The strips extend from the corresponding tension units to two rewind stands each of which has a cantileveredly supported mandrel including a driven center shaft and a separate mandrel drum or section for each strip. Each of the mandrel sections incorporates a pneumatic clutch which surrounds the drive shaft and forms a friction drive for the mandrel section from the drive shaft.

A corresponding air passage extends through the mandrel shaft for each of the air clutches, and the air pressure to each clutch is variably controlled through a corresponding pressure transducer. The pressure transducer for operating the air clutch for each strip is controlled by an optical detector which senses small changes in the depending loop formed within the strip. Thus if the loop within a strip starts to increase or lengthen, the optical detector results in producing a proportional increase in the air pressure within the air clutch for the corresponding strip so that the rewinding speed increases slightly until the loop returns to its normal depending position. Each rewind mandrel section also incorporates collapsible shoes and receives an extendible locking and orientation member which cooperate to fascilitate convenient removal of the rewound coils from the mandrel.

Other features and advantages of the invention will be apparent from the following description, the accompanying drawings and the appended claims.

DESCRIPTION OF THE PREFERRED EMBODIMENT

Figures 1, 2, 3, 4:
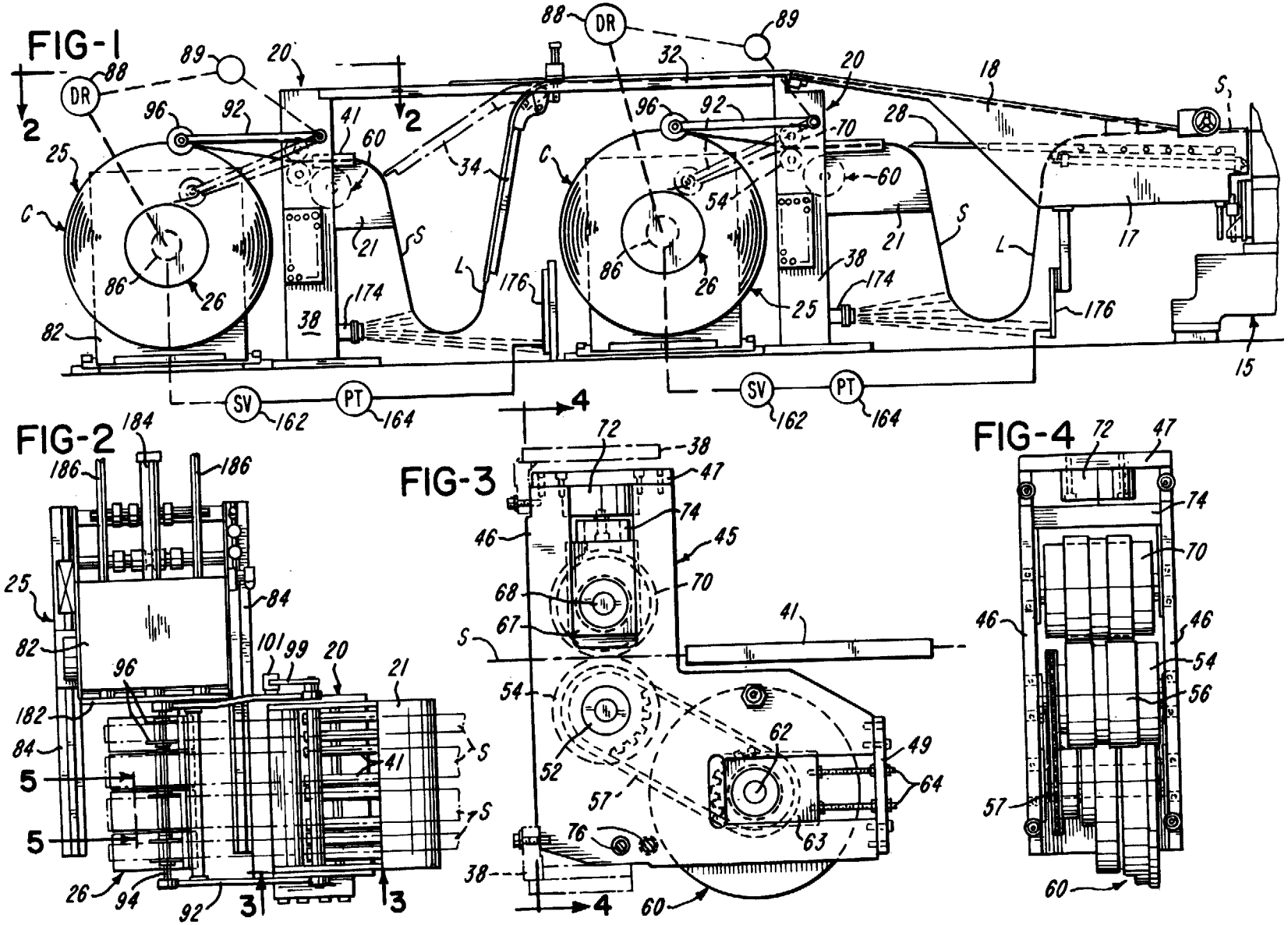
FIG. 1 is a somewhat diagrammatic elevational view of strip rewinding apparatus constructed in accordance with the invention.
FIG. 2 is a plan view of a portion of the rewinding apparatus, as taken generally along the line 2—2 of FIG. 1.
FIG. 3 is a side elevational view of a typical strip tension unit, as taken generally on the line 3—3 of FIG. 2.
FIG. 4 is an elevational view of the strip tension unit, taken as generally on the line 4—4 of FIG. 3.

Referring to FIG. 1 which illustrates generally strip rewinding apparatus constructed in accordance with the invention, a plurality of sheet metal strips S are produced by a punch press 15 which provides each strip with a predetermined configuration (not shown). For example, each strip may be in the form of a series of connected motor laminations which are subsequently separated. However, it is to be understood that the particular width and/or configuration of each strip S forms no part of the present invention, and the strips could be produced by a slitting machine so that each strip has a uniform width.

As the strips are fed from the press 15, a first set of alternate strips are directed over a table 17 and downwardly to form loops L within the strips, and a second set of alternate strips are directed above the loops L by a bridge guide platform 18. The loops L within the first set of strips S are formed between the platform 17 and a first tension stand 20 having a strip guide platform 21. From the first tension stand 20, the first set of strips S are directed to a first rewind stand or unit 25 having a mandrel 26 on which the strips are rewound into corresponding coils C. To obtain initial threading of the first set of strips S, the leading ends are guided directly from the platform 17 to the platform 21 by an extendable table 28 which is retracted after threading in order to form the loops L.

The second set of alternate strips S which are directed by the platform 18 over the first tension stand 20, are further directed by a platform 32 to a pivotably supported loop guide member 34. The loop guide member 34 is pivoted upwardly to a position shown by the dotted line for directing the leading end portions of the second set of strips into a second tension stand 20 which also has a platform 21 for guiding the strips into the tension stand. The loop guide member 34 is retracted downwardly in order to form another set of loops L within the second set of strips which are directed through the second tension stand 20 to another rewind stand or unit 25 where the second set of strips are rewound into corresponding coils C supported by a mandrel 26. Since both of the tension stands 20 are substantially identical in construction and both of the rewind stands or units 25 are substantially identical in construction, only one tension stand and one rewind stand will be described in further detail in reference to FIGS. 2–10.

Referring to FIG. 1, each of the tension stands 20 includes a frame 38 which supports the strip guide platform 21 on which is mounted a pair of strip guide rails 41 for each of the strips S. Each pair of guide rails 41 is laterally adjustable for accommodating strips of different widths. The frame 38 also supports a set of laterally spaced tension brake assemblies or units 45 (FIGS. 3 and 4) each of which includes a pair of side plates 46 rigidly connected by a top plate 47 and an end plate 49. The side plates 46 support a pair of aligned bearings 52 which rotatably support a tension roll 54 having a high friction outer surface formed by a urethane material 56. A chain drive 57 connects the tension roll 54 with an air actuated brake unit 60 having a shaft 62 supported by a pair of bearing blocks 63. The blocks 63 are supported for sliding movement by the side plates 46 in response to rotation of a set of adjusting screws 64. One form of air actuated brake unit 60 which has provided satisfactory results, is manufactured by The Horton Air Brake Company. The brake unit 60 may be water cooled in order to dissipate the heat generated by the brake.

A set of bearing blocks 67 are also supported by the side plates 46 of each tension brake unit 45 for vertical sliding movement. The blocks 67 support a shaft 68 of a pressure roll 70 which engages the corresponding tension roll 54. An air actuated fluid cylinder 72 is supported by the top plate 47 of each tension unit 45 and has a piston rod connected to a cross bar 74 secured to the bearing blocks 67. As shown in FIG. 3, each strip S is directed by the guide rails 41 through the nip defined between the corresponding pair of rolls 54 and 70. Each tension unit 45 is laterally adjustable within the frame 38 by a corresponding jack screw 76 which extends to a side wall of the frame 38.

The cylinders 72 of the brake units 45 are supplied with a preselected air pressure to cause the pressure rolls 70 to press the strips S against the tension rolls 54 with sufficient pressure to prevent slipping of each strip S relative to the high friction outer surface 56 of the corresponding tension roll 54. The tension in the strips S is then controlled by precisely adjusting the air pressure supplied to the friction drag brakes 60. Preferably, a uniform air pressure is supplied to each of the air brakes 60, and a uniform air pressure is supplied to each cylinder 72 so that a substantially constant and uniform tension is produced within all of the strips S directed through each tension stand 20 independent of slight variations in relative speeds, internal stresses within the strips and thicknesses of the strips.

Figure 5:
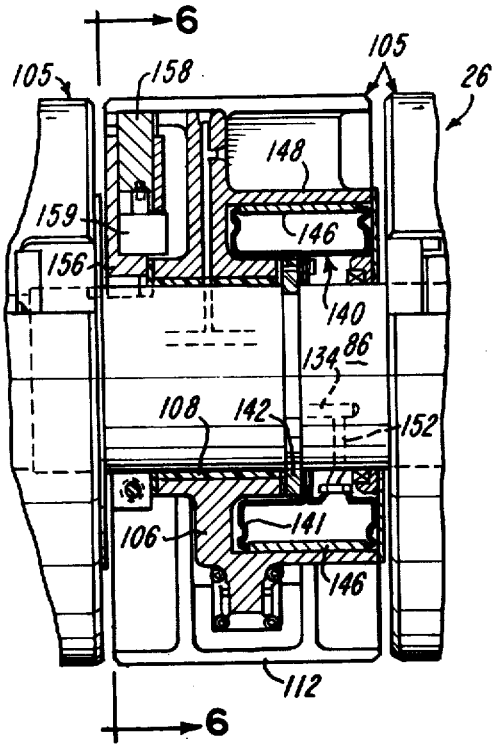
FIG. 5 is a section through one of the rewind mandrel sections, as taken generally on the line 5—5 of FIG. 2.
Figure 6:
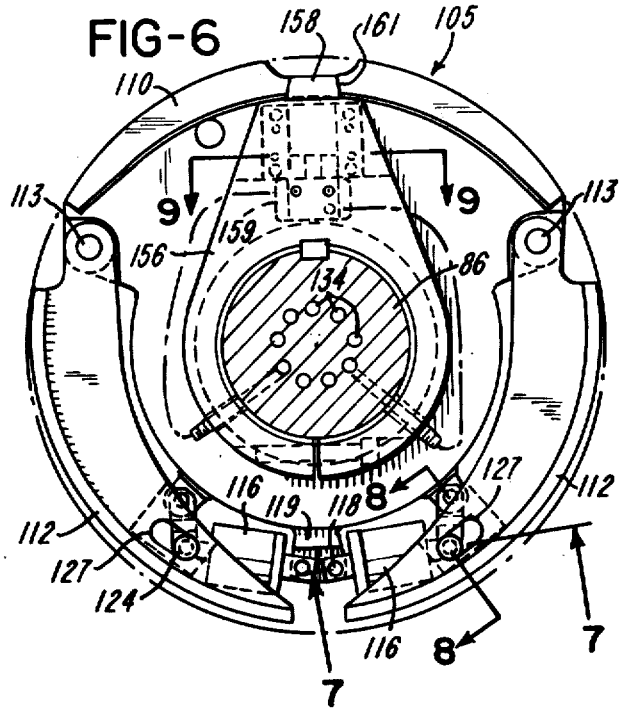
FIG. 6 is a radial section through the rewind mandrel and showing an end view of a mandrel section, as taken generally on the line 6—6 of FIG. 5.

Referring to FIGS. 2, 5 and 6, each of the rewind stands or units 25 includes a housing 82 which rotatably supports the mandrel 26 in a cantilevered manner. The unit 25 has a base supported by a pair of floor tracks 84 for lateral movement of the housing 82 in response to actuation of a fluid cylinder (not shown). The mandrel 26 includes a center shaft 86 (FIGS. 5 and 6) which is driven by a variable speed motor 88 operated by an Eddy current controller 89. The speed of the drive motor 88 is variably controlled in response to movement of a cam by a speed control arm assembly 92 which is pivotably supported by the frame 38 of the adjacent tension stand 20. The arm assembly 92 includes a cross-shaft 94 which supports a series of laterally adjustable pairs of strip guide discs 96. As the strips are rewound into corresponding coils C on the mandrel 26, the arm assembly 92 pivots upwardly or clockwise (FIG. 1) and rotates a potentiometer which progressively decreases the speed of the drive motor 88 through the controller 89. A lift arm 99 (FIG. 2) is actuated by a fluid cylinder 101 to counterbalance the weight of the control arm assembly 92.

As shown in FIGS. 5–9, the mandrel 26 of each rewind stand 25 includes a set of mandrel drums or sections 105 each of which includes a hub portion 106 supported for free rotation by a cylindrical nylon bearing material 108 mounted on the mandrel shaft 86. The hub portion 106 supports an integrally cast arcuate member 110 which has a part-cylindrical outer surface. The hub portion 106 also supports a pair of arcuate coil support shoes 112 each of which is supported for pivotal movement by a cross pin 113.

The coil support shoes 112 are movable as a unit between retracted positions (FIG. 6) and extended positions (not shown) where the outer surfaces of the shoes 112 form a continuation of the part cylindrical surface defined by the support member 110. The actuation of the shoes between their retracted and extended positions is produced by a pair of double acting air cylinders 116 (FIGS. 6 and 7) which are pivotably supported by cross-pins 118 extending through a lug 119 formed as an integral part of the hub portion 106.

Figure 7:
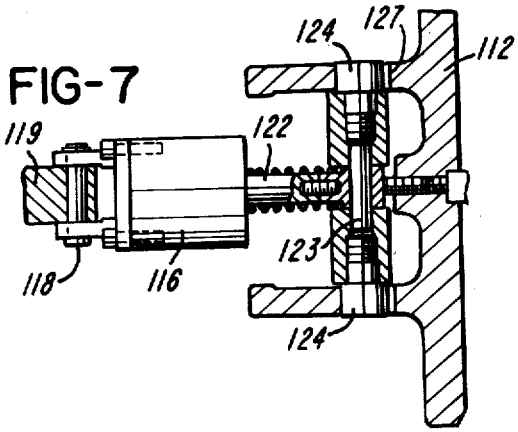
FIG. 7 is a fragmentary section taken generally on the line 7—7 of FIG. 6.
Figure 8:
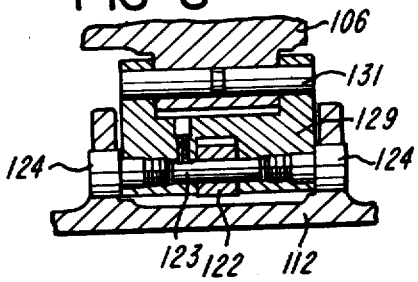
FIG. 8 is a fragmentary section taken generally on the line 8—8 of FIG. 6.
Figure 9:
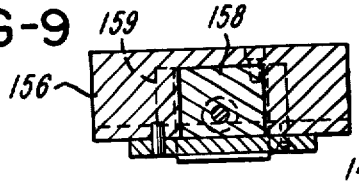
FIG. 9 is a fragmentary section taken generally on the line 9—9 of FIG. 6.

As shown in FIGS. 7 and 8, each of the air cylinders 116 has a piston rod 122 having an extension which receives a cross-shaft 123 with opposite end portions supporting a pair of rollers 124. The rollers 124 are received within corresponding slots 127 formed within the corresponding shoes 112. Each shaft 123 and hubs of the rollers 124 also extend through a toggle link 129 pivotably supported by a cross-pin 131 which extends through a projection on the hub portion 106. A simultaneous actuation of the air cylinders 116 to extend the piston rods 122, is effective to pivot the shoes 112 outwardly to their extended positions where the links 129 are disposed in generally radial planes. In these positions, the links 129 lock the shoes 112 in their extended positions for winding the corresponding coils C. This toggle-like actuation of the shoes 112 also provides for minimizing the size of the air cylinders 116. As shown in FIG. 6, a set of axially extending holes or passages 134 are formed within the center portion of the mandrel shaft 86, and two of the passages 134 are used for supplying pressurized air simultaneously to all of the air cylinders 116 within the mandrel sections 105.

Referring again to FIG. 5, each of the mandrel sections 105 also includes a fluid or air actuated annular clutch 140 which surrounds the mandrel shaft 86. The clutch 140 includes a flexible rubber bellows 141 which is secured to the shaft 86 through a ring 142. One air clutch 140 which has provided desirable results is manufactured by the Fawick Airflex Division of Eaton Yale & Town Inc. This clutch includes a plurality of circumferentially spaced part-cylindrical friction pads 146 which are adapted to engage the inner cylindrical surface of a mandrel hub portion 148. Each of the pneumatic clutches 140 receives variably controlled pressurized air through a corresponding passage 134 which is connected by a radial passage 152 to the air clutch 140. As the air supplied to each clutch 140 increases, the friction drive between the clutch pads 146 and the cylindrical hub portion 148 increases until such point when the mandrel portion 106 rotates at the same speed as the mandrel shaft 86.

As also shown in FIGS. 5 and 6, each of the mandrel sections 105 includes a hub member 156 which is keyed or locked to the shaft 86 for rotation therewith. The hub member 156 supports a mandrel locking dog 158 which is supported for radial movement between an outwardly projecting locking position (FIGS. 5 and 6) and an inwardly retracted released position in response to actuation of a double acting air cylinder 159. The double acting air cylinders 159 for all of the mandrel sections 105 are connected to operate in unison and are all connected to two of the passages 134 within the mandrel shaft 86. When extended, the dog 158 projects into a recess 161 formed within the mandrel portion 110.

Figure 10:
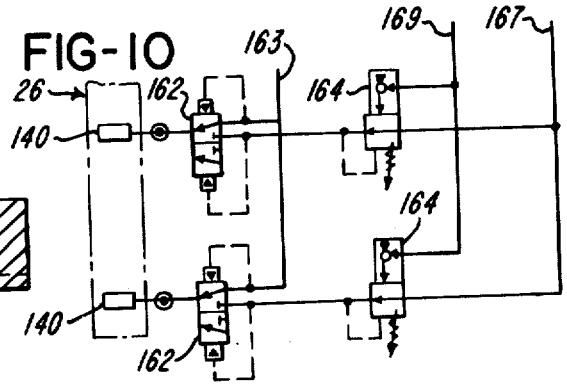
FIG. 10 is a diagram showing a portion of the control system for two of the mandrel clutches illustrated in FIG. 5.

Referring to the diagram shown in FIG. 10, each of the air clutches 140 within the mandrel sections 105 of the mandrel 26, is supplied with air through a corresponding shuttle valve 162 which, during a normal rewinding operation, receives air pressure variably controlled by a pressure transducer 164. One form of pressure transducer which has provided desirable results is manufactured by The Fairchild Corporation as the Model 5129 E/P Transducer. The transducers 164 are supplied with a constant primary air supply through a line 167, and this air supply may be on the order of 75 psi. The transducers are also supplied with a pilot air supply through a line 169 and at a lower pressure, for example, 20 psi.

Each of the pressure transducers 164 operates to control or vary the pressure of the air supplied to the corresponding air clutch 140 in response to a corresponding variation in the voltage of an electrical signal supplied to the transducer. This variable voltage signal is supplied to each of the pressure transducers by a corresponding optical sender and receiver unit 174 (FIG. 1). One form of unit 174 which has provided desirable results is manufactured by The Opcon Corporation and produces an infrared light beam. The beam is directed against the lower end portion of the loop L within the corresponding metal strip S. Each of the units 174 also senses the amount of light which is reflected by the strip S and by a corresponding vertical reflector 176 positioned on the opposite side of the corresponding loop L. The amount of reflected light received by the unit 174 determines the voltage level of the electrical signal produced by the unit 174. As mentioned above, this voltage level controls the corresponding pressure transducer 164 which, in turn, controls the air pressure to the corresponding clutch 140 within the mandrel rewind section 105 which receives the corresponding strip.

In operation of the rewinding apparatus described above, the leading end portion of each strip S is taped to the outer surface of the corresponding mandrel support member 110. A loop L is formed within each strip, and the strips are rewound into corresponding coils C which build up on the corresponding mandrel sections 105. When the coils C are completely wound, the coils are rotated until each of the mandrel sections 105 is locked to the corresponding mandrel shaft 86 by extension of the locking dog 158 into the recess 161 within the mandrel portion 110. When the mandrel sections 105 and rewound coils C are locked to the mandrel shaft 86 with the lugs 158 at the top, the mandrel shoes 112 are collapsed inwardly, and the air clutches 140 receive the maximum air line pressure through an air supply line 163 so that the mandrel sections 105 are prevented from rotating relative to the shaft 86. The rewound coils C are then stripped from the supporting mandrel 26 by extension of a stripping plate 182 (FIG. 2) which is actuated by a horizontal hydraulic cylinder 184. The plate 182 is supported and guided by a pair of guide rods 186 which extend through supports within the housing 82. As mentioned above, each of the rewind stands or units 25 is supported for lateral movement by a pair of base tracks 84 so that the mandrel 26 and rewound coils C may be shifted laterally prior to stripping of the coils C to deposit the coils onto transporting equipment (not shown).

From the drawings and the above description, it is apparent strip rewinding apparatus constructed in accordance with the invention provides desirable features and advantages. As a primary advantage, the speed at which each strip is rewound into a coil C is precisely and independently controlled by a corresponding loop detector unit 174 which precisely senses the bottom of the loop L within the corresponding strip S. In addition, the tension units 45 produce a substantially constant tension within each strip independent of variations in speed of the strip through the tension unit so that each strip is rewound into a coil C with substantially the same tightness. Thus the apparatus of the invention eliminates the need for forming pits within the floor to accommodate a progressively increasing loops in the strips due primarily to the variations in the thicknesses of the strips. That is, if a loop L within a strip S begins to lengthen so that the bottom of the loop intercepted more of the projecting infrared light from the unit 174, the air pressure within the clutch 140 for the mandrel section 105 which supports the rewound coil for the strip, proportionately increases so that the speed of the strip increases and returns the bottom of the loop L to its normal operating level or position. It is understood that each mandrel shaft 86 is driven at a speed which always produces a slight slip in all of the clutches 140.

The mandrel sections 105 also provide for locking each section to the mandrel shaft 86 which is highly desirable during stripping of the rewound coils C from the supporting mandrel 26. The actuation of the coil support shoes 112 by the roller toggle mechanism also assure positive movement of the coil support shoes 112 while minimizing the size of the double-acting air cylinders 116. In addition, each mandrel section 105 operates without the presence of any oil or other lubricant which can cause slipping of a rewinding coil C on its supporting mandrel section.

While the form of rewinding apparatus herein described constitutes a preferred embodiment of the invention, it is to be understood that the invention is not limited to this precise form of apparatus and that changes may be made therein without departing from the scope and spirit of the invention as defined in the appended claims.

The invention having thus been described, the following is claimed:

1. Apparatus for simultaneously rewinding a plurality of substantially parallel metal strips into corresponding coils after the strips are cut from a wide strip and adapted to form the coils with generally uniform tension within the strips independent of variations in the thickness and stretch of the strips, said apparatus comprising a rewind unit including a horizontal rewind mandrel having a power driven center shaft, said mandrel including a plurality of axially aligned mandrel sections mounted on said shaft for independent free rotation and adapted to receive the leading end portions of corresponding strips, each of said mandrel sections including at least one coil support shoe movable generally radially between a retracted position and an extended position, a corresponding plurality of fluid operated clutches disposed between said shaft and said mandrel sections and providing for independently driving said mandrel sections from said shaft, means defining a plurality of axially extending fluid passages within said mandrel and connected to corresponding said fluid operated clutches, means for producing a loop in each strip, means for applying a generally uniform tension within the strips between said loop forming means and said rewind unit, a corresponding plurality of loop detectors for independently sensing variations in the corresponding loops within the strips, and means responsive to said loop detectors for variably changing the fluid pressures within the corresponding said fluid operated clutches.

2. Apparatus as defined in claim 1 wherein said loop detectors comprise a plurality of light generating and sensing units each providing for a variable electric signal in proportion to the intensity of light intercepted by the corresponding loop, and a corresponding plurality of fluid pressure transducer valves connected to vary the fluid pressures within said clutches in response to variation in the electrical signals received from said light units.

3. Apparatus as defined in claim 2 wherein each of said light units includes a light source and receiver unit and a light reflector, said light source and receiver units and said light reflectors are disposed in sets of opposing relation with corresponding loops extending between said sets.

4. Apparatus as defined in claim 1 wherein said means for applying a generally uniform tension within the strips comprise a plurality of strip tension units, a frame supporting said tension units in a row extending laterally across the strips, each of said tension units including a pair of tension rolls adapted to receive the corresponding strip therebetween, adjustable fluid cylinder means for urging each pair of said rolls together, and an adjustable fluid actuated brake unit connected to restrain the rotation of one of said rolls.

5. Apparatus as defined in claim 4 and including a plurality of laterally extending adjustment screws connecting said tension units to said frame and providing for independent lateral adjustment of each said tension unit with respect to said frame.

6. Apparatus as defined in claim 1 wherein each of said fluid operated clutches comprises an annular air actuated clutch unit surrounding said shaft and secured to said shaft for rotation therewith.

7. Apparatus as defined in claim 6 wherein each of said clutch units comprises a generally cylindrical inflatable bag, and a cylindrical arrangement of clutch pads extending around said bag and secured thereto.

8. Apparatus as defined in claim 1 and including a corresponding plurality of drive members secured to said mandrel shaft for rotation therewith, a lock element supported by each said drive member for a movement between a retracted position and an extended position forming a positive coupling of said mandrel section with said shaft, and fluid actuated means within said mandrel for moving said lock elements between said retracted and extended positions.

9. Apparatus as defined in claim 8 wherein each of said lock elements is supported for movement in a generally radial direction, said fluid actuating means comprise and air cylinder for each of said lock elements, and means defining at least one air passage within said shaft and connected to all of said air cylinders.

10. Apparatus for simultaneously rewinding a plurality of substantially parallel metal strips into corresponding coils after the strips are cut from a wide strip and adapted to form the coils with generally uniform tension within the strips independent of variations in the thickness and stretch of the strips, said apparatus comprising a rewind unit including a horizontal rewind mandrel having a power driven center shaft, said mandrel including a plurality of axially aligned mandrel sections mounted on said shaft for independent free rotation and adapted to receive the leading end portions of corresponding strips, each of said mandrel sections including a pair of coil support shoes each movable generally radially between a retracted position and an extended position, a corresponding plurality of air operated cylindrical clutches surrounding said shaft and providing for independently driving said mandrel sections from said shaft, means defining a plurality of axially extending air passages within said shaft and connected to corresponding said air operated clutches, means for producing a loop in each strip, a corresponding plurality of air actuated tension units each having a set of rolls for applying a generally uniform tension within the strips between said loop forming means and said rewind unit, a corresponding plurality of optical loop detectors for independently sensing variations in the corresponding loops within the strips, and means responsive to said loop detectors for variably changing the air pressures within the corresponding said fluid operated clutches.

11. Apparatus as defined in claim 10 wherein said loop detectors comrise a plurality of light generating and receiving units each providing for a variable electric signal in proportion to the intensity of reflected light intercepted by the corresponding loop, and a corresponding plurality of air pressure transducer valves connected to vary the air pressures within said clutches in response to variation in the electrical signals received from said light units.

12. Apparatus as defined in claim 10 including a frame supporting said tension units in a row extending laterally across the strips, each of said tension units including an adjustable air cylinder for urging each set of said rolls together, and an adjustable air actuated friction brake having a shaft connected to restrain the rotation of one of said rolls.

13. Apparatus as defined in claim 12 and including a plurality of laterally extending adjustment jack screws connecting said tension units to said frame and providing for independent lateral adjustment of each said brake unit with respect to said frame.

14. Apparatus as defined in claim 10 wherein each of said clutch units comprises an annular inflatable bag, and an arrangement of part-cylindrical clutch pads extending around said bag and secured thereto.

15. Apparatus as defined in claim 10 wherein each of said mandrel sections includes a hub member secured to said mandrel shaft for rotation therewith, a lock element supported by each said drive hub member for radial movement between a retracted position and an extended position locking of said mandrel section to said shaft, and an air actuated cylinder within each said mandrel section for moving said lock element between said retracted and extended positions.

* * * * *